US009468967B2

(12) United States Patent
Mochizuki

(10) Patent No.: US 9,468,967 B2
(45) Date of Patent: Oct. 18, 2016

(54) PIPE END CORRECTION METHOD OF SEAMLESS PIPE MADE OF HIGH CR STAINLESS STEEL

(75) Inventor: Toshio Mochizuki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 488 days.

(21) Appl. No.: 13/985,335

(22) PCT Filed: Feb. 14, 2012

(86) PCT No.: PCT/JP2012/000948
§ 371 (c)(1),
(2), (4) Date: Aug. 14, 2013

(87) PCT Pub. No.: WO2012/111307
PCT Pub. Date: Aug. 23, 2012

(65) Prior Publication Data

US 2013/0333429 A1 Dec. 19, 2013

(30) Foreign Application Priority Data

Feb. 15, 2011 (JP) ..... 2011-030014

(51) Int. Cl.
*B21D 41/02* (2006.01)
*C10M 105/24* (2006.01)
*C22C 38/44* (2006.01)

(52) U.S. Cl.
CPC ..... *B21D 41/02* (2013.01); *B21D 41/026* (2013.01); *C10M 105/24* (2013.01); *C22C 38/44* (2013.01); *C10M 2207/1253* (2013.01); *C10N 2210/02* (2013.01); *C10N 2240/402* (2013.01); *C10N 2240/406* (2013.01); *C10N 2240/409* (2013.01)

(58) Field of Classification Search
CPC ..... B21D 39/00; B21D 39/20; B21D 41/02; B21D 41/026
See application file for complete search history.

(56) References Cited

U.S. PATENT DOCUMENTS

2009/0090439 A1* 4/2009 Akiyama ..... C10M 105/24 148/591
2011/0024005 A1 2/2011 Suwabe

FOREIGN PATENT DOCUMENTS

| | | |
|---|---|---|
| CN | 1744956 | 3/2006 |
| CN | 1884609 | 12/2006 |
| CN | 101410199 | 4/2009 |
| CN | 101437973 | 5/2009 |
| CN | 101460265 | 6/2009 |
| CN | 101755059 | 6/2010 |
| JP | 11-061267 | 3/1999 |
| JP | 2006-000916 | 1/2006 |
| JP | 2010-142810 | 7/2010 |
| WO | 2007/114176 | 10/2007 |
| WO | 2007/132851 | 11/2007 |

* cited by examiner

*Primary Examiner* — Teresa M Ekiert
(74) *Attorney, Agent, or Firm* — Clark & Brody

(57) ABSTRACT

The pipe end correction method for correcting an inner diameter of pipe end of a seamless pipe made of a high Cr stainless steel containing 8 to 35 mass % Cr, and 0.1 to 10 mass % Ni includes a pipe end correction step following hot tube-making and heat treatment, that forces a plug into the inside of pipe end portion for inner diameter correction so as to expand the pipe end portion while oxide scale, which is generated during tube-making or heat treatment, remains accumulated on an inner surface of the pipe end portion. A lubricant film forming step, prior to the pipe end correction step, applies lubricant at least either on the inner surface of the pipe end portion of the seamless pipe or on a surface of the plug. Seizure flaws can be prevented on the inner surface of the pipe end portion of the high Cr stainless steel.

6 Claims, 3 Drawing Sheets

PIPE END CORRECTION METHOD OF SEAMLESS PIPE MADE OF HIGH CR STAINLESS STEEL

TECHNICAL FIELD

The present invention relates to a pipe end correction method of a seamless pipe that corrects an inner diameter of pipe end of a seamless pipe made of a high Cr stainless steel such as a martensitic stainless steel and a duplex stainless steel.

BACKGROUND ART

Seamless pipes produced by hot working such as the hot extrusion tube-making process and the Mannesmann tube-making process as line pipes are often used in pipe lines for transporting oil and natural gas. In installation of pipe lines, the seamless pipes are connected by successively joining their end faces to each other by welding. For this welding, the seamless pipes for use in line pipes are required to be excellent in dimensional accuracy of their pipe ends, particularly dimensional accuracy of their inner diameters. The seamless pipes produced in the same manner are often used as oil well pipes for oil wells and gas wells (collectively referred to as "oil wells", hereinafter), and also required to have excellent dimensional accuracy of their pipe ends.

Recently, there has been a trend to require more enhanced dimensional accuracy in inner diameters of pipe ends of seamless pipes, and acceptable dimensional tolerance thereof has been increasingly tighter. Consequently, in seamless pipes for use in line pipes and oil well pipes, inner diameters of their pipe ends are required to be corrected. This pipe end correction is carried out by forcing a plug into a pipe end portion of a seamless pipe for inner diameter correction so as to expand the pipe end portion.

Prior art techniques pertinent to the pipe end correction of seamless pipes are as follows.

Patent Literature 1 discloses a lubricant for cold working made of alkali soap, which can also be applied to pipe expansion (pipe end correction) at a pipe end portion by use of a plug. This Patent Literature also discloses a technique that applies an alkali soap solution or a hydrous alkali soap paste to a surface to be processed for a seamless pipe, or a surface of a tool (an inner surface of the pipe end portion or the surface of the plug in the case of pipe end correction) so as to form a solid alkali soap film thereon, and thereafter carries out cold working (pipe end correction). In the technique disclosed in this Patent Literature, in the cold working of the seamless pipe, the lubrication film of the solid alkali soap is formed on the surface to be processed so as to reduce load during the cold working, and after the cold working, the water-soluble lubrication film can be easily removed by cleansing the processed surface with water or hot water.

Patent Literature 2 discloses a plug including a two-stepped tapered portion whose diameter gradually increases from the nose of plug, and a constant diameter portion having a constant diameter that back-to-back extends from the rear end of the tapered portion, in which a dimensional relation between the diameter of the constant diameter portion, and a taper angle and an axial length of each tapered portion is optimized. The technique disclosed in this Patent Literature uses the plug having a shape optimized in this manner in the pipe end correction so as to suppress a phenomenon that the inner diameter of the pipe end portion of the seamless pipe becomes excessively larger than the diameter of the constant diameter portion of the plug (overshoot), thereby enhancing the dimensional accuracy of the pipe end inner diameter.

Meanwhile, since pipe lines are exposed to corrosive gases such as carbon dioxide gas and hydrogen sulfide, seamless pipes for use in line pipes are required to have corrosion resistance and stress corrosion cracking resistance, and further required to have excellent properties such as weldability, toughness, and strength. The same properties are required in seamless pipes for use in oil wells. Martensitic stainless steels such as 13% Cr steels (13% Cr-0.2% C) specified by API (American Petroleum Institute) are often used in seamless pipes for use in line pipes. Recently, in order to further enhance corrosion resistance, improved 13% Cr steels containing extremely small amount of C, and containing Ni instead of C have been put into practical use. Austenite-ferrite based duplex stainless steels containing large amount of Cr such as 22% Cr steels and 25% Cr steels are often used in seamless pipes for use in oil wells.

In production of a seamless pipe made of a martensitic stainless steel represented by an improved 13% Cr steel, heat treatment is carried out after hot tube-making. It is also necessary to can out subsequent treatments such as shot-blasting and acid pickling. Oxide scale generated during the hot tube-making and/or the heat treatment are accumulated in a layered manner on the inner and outer surfaces of the seamless pipe after the heat treatment, and such accumulated oxide scale hinders corrosion resistance required in the seamless pipe, and for this reason, the above treatments are carried out to remove the oxide scale.

Seamless pipes made of improved 13% Cr steels are also required to have tight dimensional tolerance in inner diameters of pipe ends, and thus the pipe end correction becomes essential. In the production of a seamless pipe of a martensitic stainless steel, the pipe end correction is carried out after removal of the oxide scale (see Patent Literature 3, for example).

In the case of production of a seamless pipe of a duplex stainless steel, the same treatments are applied as those in the production of the seamless pipe of a martensitic stainless steel, and the pipe end correction is carry out as well.

CITATION LIST

Patent Literature

Patent Literature 1: International Application Publication No. WO2007/132851

Patent Literature 2: International Application Publication No. WO2007/114176

Patent Literature 3: Japanese Patent Application Publication No. 2010-142810

SUMMARY OF INVENTION

Technical Problem

Unfortunately, as described later, it has been found that an improved 0.13% Cr stainless steel (martensitic stainless steel) as a high Cr stainless steel is used to make a seamless pipe, and shotblasting and acid pickling treatments are applied to this seamless pipe so as to remove oxide scale, and thereafter, this seamless pipe is subjected to pipe end correction; as a result of this, seizure flaws are generated on the inner surface of the pipe even though the alkali soap lubricant disclosed in Patent Literature 1 is used. It is considered that a solid alkali soap film that provides lubricant effect is removed due to the forcing of a plug during the pipe end correction, so that the inner surface of the pipe end portion comes in direct contact with the surface of the plug, which generates excessive friction therebetween.

An object of the present invention, which has been made in order to solve the problems encountered in the prior art, is to provide a pipe end correction method of a seamless pipe having the following features, in the case of producing a seamless pipe made of a high Cr stainless steel as a martensitic stainless steel such as an unproved 13% Cr steel and as a duplex stainless steel:

Preventing seizure flaws from being generated on an inner surface of a pipe end portion during pipe end correction.

Solution to Problem

The summaries of the present invention are as follows.

The pipe end correction method of a seamless pipe for correcting an inner diameter of pipe end of a seamless pipe made of a high Cr stainless steel containing 8 to 35 mass % Cr, and 0.1 to 10 mass % Ni, includes:

a pipe end correction step, after hot tube-making and heat treatment, of forcing a plug into the inside of an pipe end portion of the seamless pipe for inner diameter correction so as to expand the pipe end portion while oxide scale remains accumulated on an inner surface of the pipe end portion of the seamless pipe, the oxide scale being generated during the tube-making or the heat treatment; and a lubricant film forming step, prior to the pipe end correction step, of applying lubricant at least either on the inner surface of the pipe end portion of the seamless pipe or on a surface of the plug, so as to form a lubricant film thereon.

The above described pipe end correction method is preferable in the case in which the high Cr stainless steel is a martensitic stainless steel containing 8 to 18 mass % Cr, and 0.1 to 10 mass % Ni.

The above described pipe end correction method is also preferable in the case in which the high Cr stainless steel is a duplex stainless steel containing 20 to 35 mass % Cr, and 3 to 10 mass % Ni.

In the above described pipe end correction method, an alkali soap solution or hydrous alkali soap paste may be preferably used as the lubricant applied in the lubricant film forming step.

In the above described pipe end correction method, shotblasting and acid pickling treatments may be preferably applied to the seamless pipe after the pipe cud correction stop.

Advantageous Effects of Invention

The pipe end correction method of the seamless pipe of the present invention has the following significant effect.

Even in the case of producing a seamless pipe made of a martensitic stainless steel represented by an improved 13% Cr steel, it is possible to prevent seizure flaws from being generated on the inner surface of a pipe end portion during the pipe end correction.

BRIEF DESCRIPTION OF DRAWINGS

FIG. 2(*a*) shows a state before the correction, FIG. 2(*b*) shows a state during the correction, and FIG. 2(*c*) shows a state after the correction.

DESCRIPTION OF EMBODIMENTS

Figure 1:
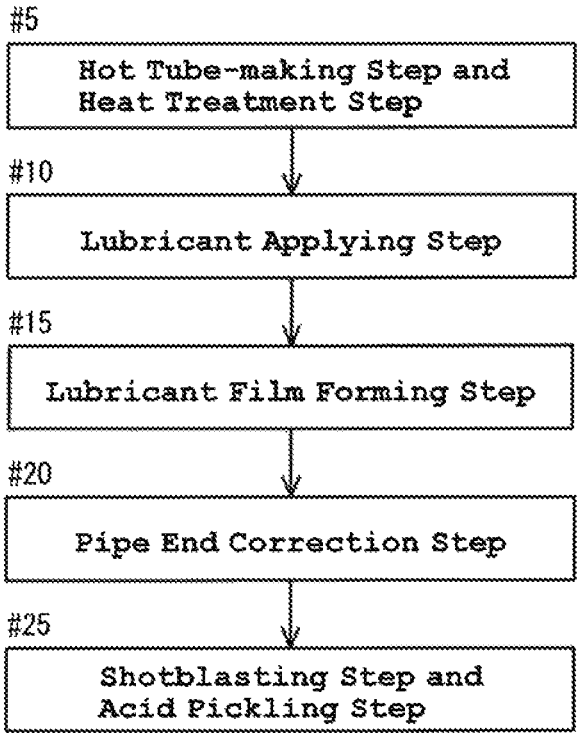
FIG. 1 is a flow chart depicting the pipe end correction method of a seamless pipe of the present invention.

In order to achieve the aforementioned objective, the present inventor has conducted various tests of the pipe end correction under various conditions, and have studied on the assumption of producing a seamless pipe of a high Cr stainless steel represented by a martensitic stainless steel (improved 13% Cr steel) or a duplex stainless steel. As a result of the tests, the findings (a) to (c) below have been obtained.

(a) It is possible to prevent seizure flaws from being generated on an inner surface of a pipe end portion of the seamless pipe without carrying out shotblasting and acid pickling treatments after hot tube-making and heat treatment processes, and applying lubricant at least either on the inner surface of the pipe end portion of the seamless pipe or on a surface of as plug while oxide scale remains as being accumulated on the inner surface of the pipe end portion of the seamless pipe, which are generated during the hot tube-making and/or the heat treatment, and forming a lubricant film thereon, and thereafter carrying out the pipe end correction.

(b) It is possible to significantly reduce load during the pipe end correction by using the alkali soap lubricant disclosed in Patent Literature 1 as the lubricant shown in (a) above, thereby more securely preventing generation of seizure flaws.

(c) Accumulation of the oxide scale on the inner and outer surfaces of the seamless pipe hinders corrosion resistance required for the seamless pipe, so that it is required to completely remove the oxide scale. For the purpose of this, shotblasting and acid pickling treatments may be applied to the seamless pipe after the pipe end correction. Through the treatments, it is possible to remove the oxide scale as well as the lubricant film at the same time.

The present invention has been accomplished based on the above findings of (a) to (c). Hereinafter, description will be provided on the preferable embodiment of the pipe end correction method of the seamless pipe of the present invention.

1. Chemical Composition of Seamless Pipe

A specific chemical composition of the high Cr stainless steel employed in the present invention is as follows. The symbol "%" in composition content denotes "mass %" in the following description.

(1) Improved 13% Cr steel (martensitic stainless steel)

Cr: 8.0 to 18.0%

Cr is an element effective to enhance corrosion resistance in an environment subjected to a carbon dioxide gas, and the Cr content should be not less than 8.0% for the purpose of preventing pitting and crevice corrosion. The Cr content of more than 18.0% not only saturates its effect of enhancing corrosion resistance, and causes increase in cost, but also produces δ ferrite during heating for hot working, which deteriorates hot workability. Accordingly, the preferable range of the Cr content is set to be 8.0 to 18.0%. More preferable range thereof is 12.0% to 13.5%.

Ni: 0.1 to 10.0%

Ni is an austenite stabilizing element, and has effect of significantly enhancing that workability. The Ni content of less than 0.1% cannot attain effect of enhancing corrosion resistance, and the Ni content of more than 10.0% not only saturates its effect, and causes increase in cost, but also causes the increase of proportion of austenite in the microstructure, which results in decrease of YR. Accordingly, the preferable range of the Ni content is set to be 0.1 to 10.0%. More preferable range thereof is 0.5 to 2.0%.

The improved 13% Cr steel used in the present invention may further contain the following elements other than the above alloy elements.

C: 0.01 to 0.1%

C is an element effective to enhance strength. The C content of less than 0.01% cannot attain preferable strength, and the C content of more than 0.1% causes extreme increase in strength, which results in significant deterioration of toughness. Accordingly, the C content is preferably set to be within a range of 0.01 to 0.1%. The more preferable range thereof is 0.02% to 0.06%.

Si: 0.05 to 1.0%

Si is an effective element as a deoxidizer, but the Si content of less than 0.05% exhibits merely poor effect despite additive. The Si content of more than 1.0% rather deteriorates toughness. Accordingly, the Si content is preferably set to be within a range of 0.05% to 1.0%.

Mn: 0.05% to 1.5%

Mn is an element effective to enhance strength. Mn is an austenite forming element, and has effect of suppressing precipitation of δ ferrite during quenching, and stabilizing the microstructure to form martensite. The Mn content of less than 0.05% attains only small effect. On the other hand, the Mn content of more than 1.5% deteriorates toughness and corrosion resistance. Accordingly, the Mn content is preferably set to be within a range of 0.05 to 1.5%.

Cu: 0.1 to 5.0%

Cu has effect of chancing corrosion resistance in an environment subjected to $Cl_2$, $H_2S$, and carbon dioxide gas. Cu is an austenite stabilizing element, and has effect of suppressing δ ferrite formation during heating for hot working, and enhancing hot workability. The Cu content of less than 0.1% cannot attain the above effect. Cu is a low melting point metal, and the excessive Cu content rather deteriorates hot workability, and particularly the Cu content of mom than 5.0% significantly deteriorates hot workability. Accordingly, the Cu content is preferably set to be within a range of 0.1% to 5.0%.

Mo: 0.1 to 3.0%

Mo is effective to enhance corrosion resistance in an environment subjected to carbon dioxide gas, as similar to Cr, and particularly has effect of protecting a corrosion resistant film. The Mo content of less than 0.1%, however, cannot attain sufficient effect. On the other hand, the Mo content of more than 3.0% deteriorates hot workability. Accordingly, the Mo content is preferably set to be within a range of 0.1 to 3.0%.

V: 0.01 to 0.20%

V has effect of forming carbide, and enhancing strength. The V content of less than 0.01% exhibits only poor effect despite addition, and on the other hand, the V content of more than 0.20% significantly deteriorates toughness. Accordingly, the V content is preferably set to be within range of 0.01 to 0.20%.

Al: not more than 0.05%

Al may be unnecessary to be added. Al is however, an effective element as a deoxidizer, and the Al content is set to be not less than 0.0005% if added as a deoxidizer, but the Al content of more than 0.05% deteriorates toughness of the steel. Accordingly, the Al content is preferably set to be not more than 0.05%.

N: not more than 0.1%

N may be unnecessary to be added because N deteriorates toughness, but N is an element effective to suppress precipitation of δ ferrite during quenching, and stabilize the metal microstructure of steel to form martensite, and thus N may be added if necessary. The N content of more than 0.1% significantly deteriorates toughness. The N content of more than 0.1% likely causes weld cracks during welding. Accordingly, the N content is preferably set to be not more than 0.1%.

P: not than 0.03%

P is an element contained in steel as an impurity, and likely segregates to grain boundaries, and deteriorates toughness. Particularly, the P content of more than 0.03% significantly deteriorates toughness. Accordingly, the P content in impurities is preferably limited to be not more than 0.03%.

S: not more than 0.01%

S is an element contained in steel as an impurity and deteriorates hot workability and toughness. Particularly, the S content of more than 0.01% significantly deteriorates hot workability and toughness. Accordingly, the S content in impurities is preferably limited to be not more than 0.01%.

(2) Duplex Stainless Steel

Cr: 20 to 35%

Cr is a basic component effective to maintain corrosion resistance, and enhance strength. In order to attain this effect, the Cr content should be not less than 20%. The Cr content of more than 35%, however, likely causes precipitation of α phase, resulting in deterioration of corrosion resistance and toughness. Accordingly, the Cr content is set to be 20 to 35%. The Cr content is preferably set to be not less than 23% so as to attain greater strength. In the light of securing toughness, the Cr content is preferably set to be not more than 28%.

Ni: 3 to 10%

Ni is an element for stabilizing austenite phase, and is contained to attain a two-phase microstructure. The Ni content of less 3% than mostly forms ferrite phase, so that the two-phase microstructure cannot be attained. On the other hand, the Ni content of more than 10% mostly forms the austenite phase, so that the two-phase microstructure cannot be attained, and Ni is an expensive element to adversely affect economic efficiency; thus the Ni content is set to be 3 to 10%. The upper limit thereof is preferably set to be 8%.

The duplex stainless steel employed in the present invention may further contain the following elements other than the above alloy elements.

C: not more than 0.03%

C is an element having effect of stabilizing the austenite phase, enhancing strength, and precipitating carbide at the time of heatup during heat treatment, thereby attaining the fine microstructure. At the C content of more than 0.03%, precipitation of carbide becomes excessive due to thermal influence during heat treatment and welding, resulting in deterioration of corrosion resistance and workability of steel. Accordingly, the upper limit of the C content is set to be 0.03%. The preferable upper limit is 0.02%.

Si: not more than 1%

Si is an effective element as a deoxidizer, and has effect of precipitating an intermetallic compound at the time of heatup during heat treatment so as to obtain the fine microstructure, and thus Si may be added if necessary. The Si content of not less than 0.05% attains the above effect. At the Si content of more than 1%, precipitation of the intermetallic compound becomes excessive due to affecting by heat during heat treatment and welding, resulting in deterioration of corrosion resistance and workability of steel; therefore, the Si content is set to be not more than 1%. The preferable range thereof is not more than 0.7%.

Mn: 0.1 to 2%

Mn is an effective element as a deoxidizer, similarly to Si, and immobilizes S inevitably contained in steel as sulfide so as to enhance hot workability. The Mn content of not less than 0.1% attains its effect. The Mn content of more than 2% not only deteriorates hot workability, but also causes adverse influence to corrosion resistance. Accordingly, the Mn content is set to be 0.1 to 2%. The preferable Mn content is within a range of 0.3 to 1.5%.

Mo: 0 to 4% (including no addition)

Mo is an element for enhancing pitting resistance and crevice corrosion resistance, and also enhancing strength through solid-solution strengthening, and thus Mo may be added if necessary. In order to attain this effect, the Mo content is preferably set to be not less than 0.5%. On the other hand, the excessive Mo content likely causes precipitation of the $\alpha$ phase, which deteriorates toughness. Accordingly, the Mo content is preferably set to be within a range of 0.5 to 4%.

W: 0 to 6% (including no addition)

W is an element for enhancing pitting resistance and crevice corrosion resistance, and also enhancing strength through solid-solution strengthening, similarly to Mo, and thus W may be added if necessary. In order to attain this effect, the W content is preferably set to be not less than 0.5%. On the other hand, the excessive W content likely causes precipitation of the $\alpha$ phase, which deteriorates toughness. Accordingly, the W content is preferably set to be within a range of 0.5 to 6%.

Both Mo and W may be unnecessary to be added, and either or both of Mo; 0.5 to 4% and W: 0.5 to 6% may be added.

Cu: 0 to 3% (including no addition)

Cu is an element for enhancing corrosion resistance and intergranular corrosion resistance, and may be added it necessary. In order to attain this effect, the Cu content is preferably set to be not less than 0.1%, and more preferably not less than 0.3%. The Cu content of more than 3% saturates its effect, and rather deteriorates hot workability and toughness. Accordingly, if Cu is added, the Cu content is preferably set to be 0.1 to 3%. The more preferable Cu content is 0.3 to 2%.

N: 0.15 to 0.35%

N is an element for enhancing stabilization of austenite, and enhancing pitting resistance and crevice corrosion resistance of the duplex stainless steel. N is an important element or stabilizing the austenite phase, and enhancing strength, similarly to C. The N content of less than 0.15% cannot attain its sufficient effect. On the other hand, the N content of more than 0.35% deteriorates toughness and hot workability; therefore the N content is set to be 0.15 to 0.35%. In order to attain higher strength, the N content is preferably set to be more than 0.17%. The more preferable N content is 0.2 to 0.3%.

P, S, O contained as impurities are preferably limited such that P; not more than 0.04%, S; not more than 0.03%, and O; not more than 0.010%, for the following reasons.

P: not more than 0.04%

P is contained as an impurity, and the P content of more than 0.04% deteriorates hot workability, and also deteriorates corrosion resistance and toughness. Accordingly, the upper limit of the P content is preferably set to be 0.04%.

S: not more than 0.03%

S is contained as an impurity, similarly to P, and at the S content of more than 0.03%, not only hot workability is significantly deteriorated, but also sulfide becomes initiation of pitting, which hinders pitting resistance. Accordingly, the upper limit of the S content is preferably set to be 0.03%.

O: not more than 0.010%

The duplex stainless steel contains a large amount of N a being 0.15 to 0.35% so that hot workability is likely deteriorated. Accordingly, the O content is preferably set to be not more than 0.010%.

The duplex stainless steel may further contain Ca, Mg, and one or more of rare earth metals (REM) other than the above elements. The reason for containing these elements, and each content thereof are as follows.

Ca: not more than 0.01%, Mg: not more than 0.01, and one or more of rare earth metals; not more than 0.2%

These components may be added if necessary. Any of these components has effect of immobilizing S that hinders hot workability as sulfide, and enhancing hot workability if added. The Ca content and the Mg content of more than 0.01%, and the REM content of more than 0.2% generate coarse oxide, and rather deteriorate hot workability. Accordingly, the upper limits of the Ca content and the Mg content are set to be 0.01%, and the upper limit of the REM content is sot to be 0.2%. In order to securely attain the advantageous effect of enhancing hot workability, it is preferable to contain Ca: not less than 0.0005% and Mg: not less than 0.0005%, and to contain REM: not less than 0.001%, respectively. Note that REM denotes 17 elements including Y and Sc in addition to 15 elements of the lanthanide series.

2. Pipe End Correction Method

FIG. 1 is a flow chart depicting the pipe end correction method of the seamless pipe of the present invention. As shown in this drawing, the seamless pipe is produced by hot working such as the hot extrusion tube-making process and the Mannesmann tube-making process, and this seamless pipe is subjected to heat treatment so as to form martensite microstructure in the hot tube-making and heat treatment step of step #5, and thereafter, lubricant is applied on the inner surface of the pipe end portion of the seamless pipe in the lubricant applying step of step #10. In this step, the seamless pipe is not subjected to shotblasting and acid pickling treatments, so that oxide scale is still accumulated on the inner and outer surfaces of the seamless pipe. Specifically, the lubricant is applied onto the oxide scale of the inner surface of the pipe end portion. The lubricant to be applied will be described in detail later.

The application method of the lubricant is not specifically limited. For example, such a method may be employed that directly applies the lubricant with a brush, or immerses the seamless pipe in a bath filled with the lubricant. A method for spraying the lubricant through a nozzle may also be employed.

Next, in the lubricant film forming step of step #15, the seamless pipe is dried so as to form the lubricant film on the inner surface of the pipe end portion. The drying method in this step may be natural drying or forced drying using a blower or the like. This step allows the lubricant to firmly adhere on the inner surface of the pipe end portion.

In the lubricant applying step of step #10 and in the lubricant film forming step of step #15, as the as the oxide scale is accumulated on the inner surface of the pipe end portion, the formation of the lubricant film an the inner surface of the pipe end portion may be replaced with applying the lubricant on the surface of a plug used in the pipe end correction step of step ∩20 so as to form the lubricant film on the plug. The lubricant film may be formed on both the inner surface of the pipe end portion and the surface of the plug.

Following the lubricant film forming step, in the pipe end correction step of step #20, the pipe end correction is carried out so as to correct the pipe end inner diameter of the seamless pipe.

Figure 2:
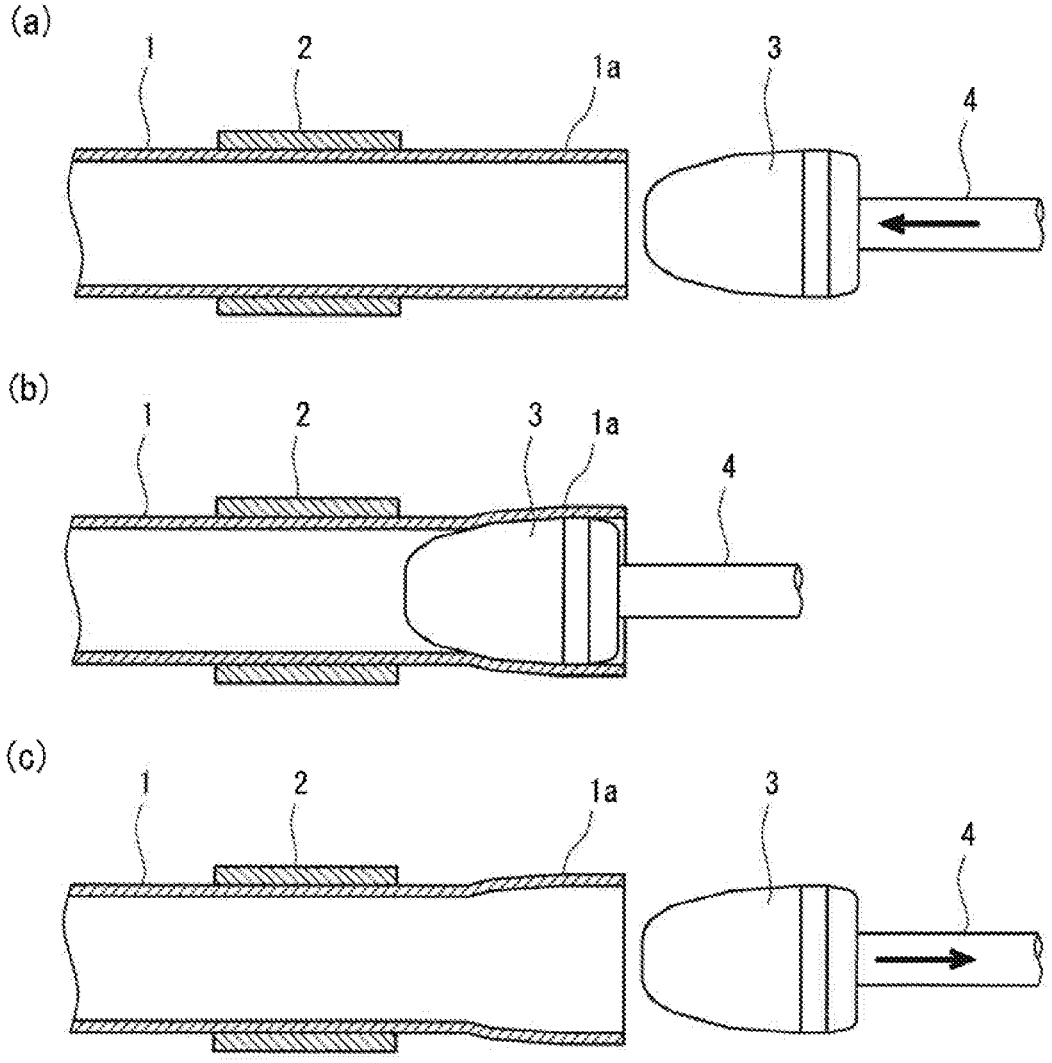
FIG. 2 is a schematic diagram showing the procedure of the pipe end correction in the pipe end correction method of the seamless pipe of the present invention.

FIG. 2 is a schematic diagram showing the procedure of the pipe end correction in the pipe end correction method of the seamless pipe of the present invention, FIG. 2(*a*) shows a state before the correction, FIG. 2(*b*) shows a state timing the correction, and FIG. 2(*c*) shows a state after the correction. In the pipe end correction, as shown in FIG. 2(*a*), the seamless pipe 1 is fixed by a chucking jig 2. In this state, a plug 3 for the inner diameter correction jointed to a cylinder rod 4 that is as driving source is moved toward the pipe end portion 1*a* in an axial direction of the seamless pipe 1 so as to be inserted into the pipe end portion 1*a*.

As shown in FIG. 2(*b*), the plug 3 is forced into a predetermined position of the pipe end portion 1*a* of the seamless pipe 1 so as to expand the pipe end portion 1*a* of the seamless pipe 1. Through this process, the inner diameter of the pipe end of the seamless pipe 1 is corrected to have approximately the same diameter as the maximum diameter of the plug 3. Thereafter, as shown in FIG. 2(*c*), the plug 3 is moved backward and pulled out of the seamless pipe 1 to complete the pipe end correction.

While the oxide scale generated during hot tube-making and/or heat treatment remain accumulated on the inner surface of the pipe end portion 1*a* of the seamless pipe 1, the lubricant is applied at least either on the inner surface of the pipe end portion 1*a* of the seamless pipe 1 or on the surface of the plug 3, and the lubricant film is formed thereon, and thereafter the pipe end correction is carried out in this manner, thereby preventing seizure flaws from being generated on the inner surface of the pipe end portion 1*a*.

This is because of the following reasons. If the lubricant is applied onto the oxide scale accumulated on the inner surface of the pipe end portion 1*a*, the lubricant permeate into the oxide scale, thereby forming the lubricant film firmly adhering to the scale. On the other hand, in the case of applying the lubricant on the surface of the plug 3, even though the lubricant film formed on the surface of the plug 3 is removed due to the forcing of the plug 3 during the pipe end correction, the lubricant is trapped into and remains on the oxide scale. In both of the above cases, the oxide scale and the lubricant film provide synergy effect on excellent lubrication to prevent direct contact between the inner surface of the pipe end portion 1*a* and the surface of the plug 3, thereby securely reducing friction therebetween.

With reference to FIG. 1 once again, the description will be continued. Following the pipe end correction, in the shotblasting and acid pickling step of step #25, shotblasting treatment of blasting steel or alumina grit to the seamless pipe is carried out, and thereafter pickling treatment is carried out by immersing the seamless pipe into respective bath filled with sulfuric acid and nitric hydrofluoric acid. Through this process, the oxide scale accumulated on the inner and outer surfaces of the seamless pipe as well as the lubricant film thereon are completely removed at the same time. Accordingly, it is possible to secure corrosion resistance required for the seamless pipe, and also prevent quality deterioration caused by the remaining lubricant film.

3. Lubricant

In the pipe end correction method of the present invention, lubricant made of alkali soap may be used as the lubricant. The alkali soap is alkali metal salt (sodium salt or potassium salt) of long chain fatty acid, and as far as this alkali metal salt is straight chain fatty acid, either saturated fatty acid or unsaturated fatty acid may be selected. It is preferable to use one or more than one of sodium salt and potassium salt of straight chain fatty acid with carbon number 10 to 18. Examples of the straight chain fatty acid may include capric acid ($C_9H_{19}COOH$), lauric acid ($C_{11}H_{23}COOH$), myristic acid ($C_{13}H_{22}COOH$), palmitic acid ($C_{15}H_{31}COOH$), palmitoleic acid ($C_1H_{29}COOH$), margaric acid ($C_{16}H_{33}COOH$), stearic acid ($C_{17}H_{35}COOH$), oleic acid ($C_{17}H_{33}COOH$), and linoleic acid ($C_{17}H_{31}COOH$).

Since alkali soap is soluble, it is easy to apply this alkali soap to the seamless pipe and or to the plug by dissolving the alkali soap in water to form an alkali soap solution. The applied alkali soap solution is dried into a solid state, and uniformly adheres on the inner surface of the seamless pipe and or the surface of the plug to form a solid alkali soap film thereon.

Instead of applying the alkali soap solution, the alkali soap may be made into a paste state containing moisture and having some flowability, and this hydrous alkali soap paste may be applied to the seamless pipe and or the plug. The hydrous alkali soap paste comes in a solid state by drying, similarly to the alkali soap solution.

If the alkali soap lubricant is used as the lubricant in the pipe end correction, it is possible to significantly reduce processing load, thereby more securely preventing generation of the seizure flaws.

Water-soluble amino salt based lubricants mainly containing fatty acid amino salt and combined with oils and fats as well as mineral oils, or cutting oils conventionally used in threading oil well pipes may be used as an example of other lubricants. It is preferable to use alkali soap rather than amino salt based lubricants and cutting oils in the light of the effect of reducing processing load of the pipe end correction.

EXAMPLE

A pipe end correction test was conducted by using seamless pipes for use in the test, which are produced through hot tube-making and heat treatment (hereinafter, referred to as "test pipe") under various conditions.

[Test Condition]

Specifications of the test pipes are as follows.

(1) Improved 13% Cr Steel (Martensitic Stainless Steel)

Material: DNV-specified SMLS13Cr-2.5Mo

Mechanical properties: API-specified 5LC-LC80 grade

Dimension: outer diameter of 298.5 mm, thickness of 15.9 mm, length of 12.0 m (2) Duplex Stainless Steel Material: C: 0.016%, Si: 0.33%, Mn: 0.47%, P: 0.019%, S: 0.0005%, Cr: 24.72%, Ni: 6.55%, Mo: 3.08%, W: 2.13% Cu: 0.46% and N: 0.275% in mass %, the balance being Fe and impurities Mechanical properties: equivalent to API-specified LC80-2507

Dimension: outer diameter of 273.1 mm, wall thickness of 25.6 mm, length of 12.0 m Test pipes of Inventive Example of the present invention were prepared without applying shotblasting treatment and acid pickling treatment so as to leave oxide scale accumulated on the inner and outer surfaces of each pipe. Test pipes of Comparative Example were prepared by applying shotblasting and pickling treatment so as to completely remove oxide scale accumulated on the inner and outer surfaces of each pipe. Lubricants of three types, which are cutting oil, amino salt based lubricant, and alkali soap solution, were prepared, and each is respectively applied to an inner surface of a pipe end portion of each pipe of Inventive Example of the present invention, and of Comparative Example, so as to form a film of each lubricant thereon. Stearic acid Na was used as the alkali soap. The test conditions are shown in Table 1 below.

TABLE 1

| Test No. | Material Grade | Oxide Scale | Lubricant | Inner Surface Condition of Pipe End Portion after Correction | Category |
|---|---|---|---|---|---|
| 1 | 13% Cr Steel | No | Cutting Oil | X | Comparative Example |
| 2 | 13% Cr Steel | No | Amino Salt Based Lubricant | X | Comparative Example |
| 3 | 13% Cr Steel | No | Alkali Soap Solution | Δ | Comparative Example |
| 4 | 13% Cr Steel | Yes | Cutting Oil | ○ | Inventive Example |
| 5 | 13% Cr Steel | Yes | Amino Salt Based Lubricant | ○ | Inventive Example |
| 6 | 13% Cr Steel | Yes | Alkali Soap Solution | ○ | Inventive Example |
| 7 | duplex Stainless Steel | Yes | Alkali Soap Solution | ○ | Inventive Example |

The pipe end correction was applied to each of the test pipes of Inventive Example and Comparative Example, that had three types of the lubricants formed. The pipe end correction was conducted three times for each condition. Such a three-stepped plug was used in the pipe end correction that includes a three-tapered portion whose diameter gradually expands from the plug nose, and a constant diameter portion having a constant diameter that back-to-back extends from the rear end of the tapered portion. The range in which the plug is forced into the inside of pipe during the pipe end correction was set to be 150 mm from the pipe end of each test pipe.

[Evaluation Method]

Figure 3:
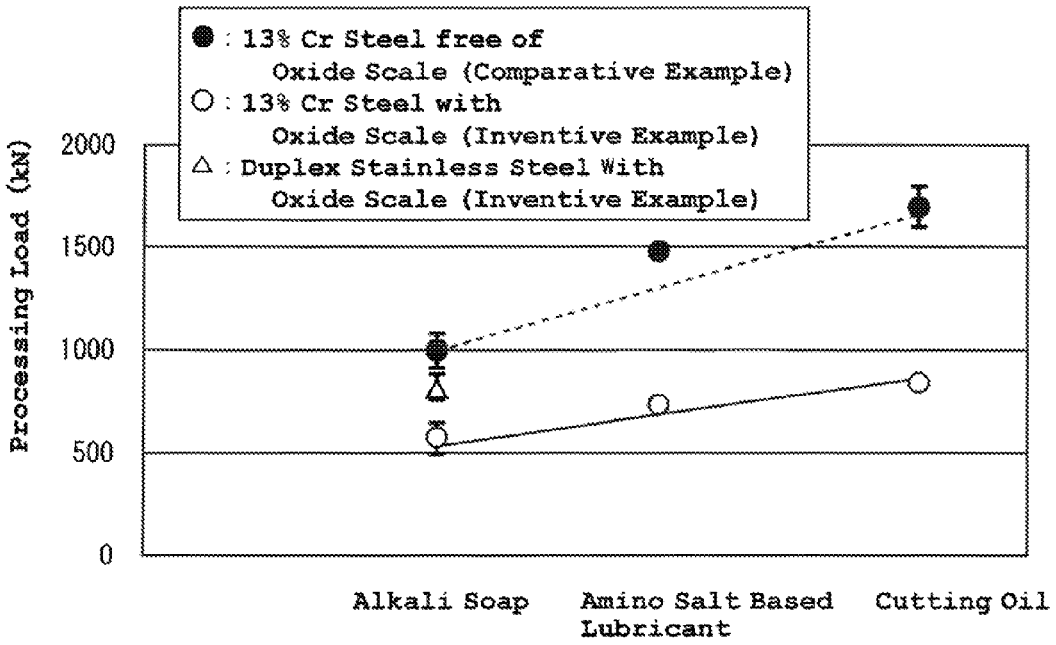
FIG. 3 is a drawing showing the presence or absence of oxide scale on an inner surface of a pipe end portion of each case, and processing load during the pipe end correction for each type of lubricants as a result of a test in Example.

The processing load during the pipe end correction was measured, and was compared among the conditions. Visual observation was also conducted on the inner surface of the pipe end portion after the pipe end correction so as to investigate its surface condition (the presence or absence of seizure flaws). The investigation result is shown in FIG. 3 below and Table 1 above.

The symbols in the column of "Inner Surface Condition of Pipe End Portion after Correction" in Table 1 denote as follows.

○: "Good" represents that no seizure flaws were observed.

Δ: "Acceptable" represents that only slight seizure flaws were observed.

x: "Poor" represents that seizure flaws were observed.

[Test Result]

FIG. 3 shows the presence or absence of oxide scale on the inner surface of the pipe end portion of each case, and the processing load during the pipe end correction for each type of the lubricants as a result of the test in Example.

The result of FIG. 3 shows the following. As shown in FIG. 3, compared to the pipe end correction of Comparative Example, that is, the pipe end correction applied to the test pipes whose oxide scale was removed (see solid circles "●" in the figure), in the pipe end correction of Inventive Example of the present invention, that is, the pipe end correction applied to the test pipes whose accumulated oxide scale was left on the inner surfaces of their pipe end portions (see outlined circles "○", and outlined triangles "Δ" in the figure), the processing load was reduced by about 50% for every type of the lubricants. Especially, the processing load was significantly reduced in the case of using the alkali soap as the lubricant.

The result of Table 1 shows the following. Seizure flaws wore not generated in every type of the lubricants in the pipe end correction of Inventive Example of the present invention, that is, the pipe end correction for Test Nos. 4 to 7 that was applied to each test pipe with the oxide scale accumulated on the inner surface of the pipe end portion of the test pipe. Note that only sneaky imperfections were confirmed, but these imperfections were very slight, and disappeared through the shotblasting and acid pickling treatments carried out after the pipe end correction. On the other hand, seizure flaws were generated in every type of the lubricants in the pipe end correction of Comparative Example, that is, the pipe end correction for Test Nos. 1 to 3 that was applied to each test pipe whose oxide scale was removed.

INDUSTRIAL APPLICABILITY

The present invention is effectively applicable to the production of seamless pipes for use in line pipes, particularly in the case of employing martensitic stainless steels represented by improved 13% Cr steels. The present invention is also effectively applicable to the production of seamless pipes for use in oil well pipes, particularly in the case of employing duplex stainless steels.

REFERENCE SIGNS LIST

1: Seamless pipe, 1*a*: Pipe end portion, 2: Chucking jig, 3: Plug, 4: Cylinder rod

What is claimed is:

1. A pipe end correction method of a seamless pipe for correcting an inner diameter of pipe end of a seamless pipe made of a high Cr stainless steel containing 8 to 35 mass % Cr, and 0.1 to 10 mass % Ni, the pipe end correction method comprising:

a hot tube-making step;

a heat treatment step;

a lubricant film forming step, following the tube-making step and the heat treatment step, of applying lubricant at least either on an inner surface of a pipe end portion of the seamless pipe or on a surface of a plug for inner diameter correction while oxide scale remains accumulated on the inner surface of the pipe end portion of the seamless pipe;

a pipe end correction step, following the lubricant film forming step, of forcing the plug into an inside of the pipe end portion of the seamless pipe so as to expand the pipe end portion;

a shotblasting step, following the pipe end correction step, of applying shotblasting to the seamless pipe; and:

an acid pickling treatment step, the shot blasting step, of acid pickling the seamless pipe.

2. The pipe end correction method of a seamless pipe according to claim 1, wherein the high Cr stainless steel is a martensitic stainless steel containing 8 to 18 mass % Cr, and 0.1 to 10 mass % Ni.

3. The pipe end correction method of a seamless pipe according to claim 2, wherein alkali soap solution or hydrous alkali soap paste is used as the lubricant applied in the lubricant film forming step.

4. The pipe end correction method of a seamless pipe according to claim 1, wherein the high Cr stainless steel is a duplex stainless steel containing 20 to 35 mass % Cr, and 3 to 10 mass % Ni.

5. The pipe end correction method of a seamless pipe according to claim 4, wherein alkali soap solution or hydrous alkali soap paste is used as the lubricant applied in the lubricant film forming step.

6. The pipe end correction method of a seamless pipe according to claim 1, wherein alkali soap solution or hydrous alkali soap paste is used as the lubricant applied in the lubricant film forming step.

* * * * *